US008384560B2

(12) United States Patent
Malarky

(10) Patent No.: US 8,384,560 B2
(45) Date of Patent: Feb. 26, 2013

(54) REAL-TIME VEHICLE POSITION DETERMINATION USING COMMUNICATIONS WITH VARIABLE LATENCY

(75) Inventor: Alastair Malarky, Petersburg (CA)

(73) Assignee: Kapsch TrafficCom IVHS Inc., McLean, VA (US)

( * ) Notice: Subject to any disclaimer, the term of this patent is extended or adjusted under 35 U.S.C. 154(b) by 950 days.

(21) Appl. No.: 12/398,808

(22) Filed: Mar. 5, 2009

(65) Prior Publication Data

US 2009/0231161 A1 Sep. 17, 2009

Related U.S. Application Data

(60) Provisional application No. 61/035,600, filed on Mar. 11, 2008.

(51) Int. Cl.
*G08G 1/065* (2006.01)

(52) U.S. Cl. ..... 340/928; 340/905; 340/936; 455/406; 701/119

(58) Field of Classification Search ..... 340/10.41, 340/10.5, 10.51, 10.52, 901, 905, 928, 933; 705/38, 417; 235/384; 342/156, 442, 446; 701/118

See application file for complete search history.

(56) References Cited

U.S. PATENT DOCUMENTS 4,104,630 A 8/1978 Chasek
4,303,904 A 12/1981 Chasek
4,870,419 A 9/1989 Baldwin et al.
4,937,581 A 6/1990 Baldwin et al.
5,128,669 A * 7/1992 Dadds et al. ..... 340/901
5,132,687 A 7/1992 Baldwin et al.
5,164,732 A 11/1992 Brockelsby et al.
5,192,954 A 3/1993 Brockelsby et al.
5,196,846 A 3/1993 Brockelsby et al.
5,289,183 A 2/1994 Hassett et al.
5,307,349 A 4/1994 Shloss et al.
5,425,032 A 6/1995 Shloss et al.
5,592,181 A 1/1997 Cai et al.
6,025,799 A 2/2000 Ho et al.
6,219,613 B1 4/2001 Terrier et al.
6,661,352 B2 12/2003 Tiernay et al.
2008/0300776 A1 * 12/2008 Petrisor et al. ..... 701/118

* cited by examiner

*Primary Examiner* — George Bugg
*Assistant Examiner* — Sisay Yacob
(74) *Attorney, Agent, or Firm* — Hanley, Flight & Zimmerman, LLC

(57) ABSTRACT

A system and method for predicting the location of a vehicle in an electronic toll collection system employing a wide area communication protocol. The vehicle includes a transponder that sends reports regarding the position of the vehicle and the time at which the position was determined. The system includes a vehicle position predictor for estimating the future position of the vehicle within a roadway based on two or more reports of past positions and the times at which they were recorded. Speed data or other data impacting likely future position may also be reported and factored into the estimate. The estimate of future position may be used in connection with triggering enforcement measures, timing a toll transaction, integrating wide area toll communications into a legacy toll transaction system, or for other applications.

30 Claims, 4 Drawing Sheets

REAL-TIME VEHICLE POSITION DETERMINATION USING COMMUNICATIONS WITH VARIABLE LATENCY

CROSS-REFERENCE TO RELATED APPLICATIONS

The present application claims priority to US provisional patent application Ser. No. 61/035,600, entitled REAL-TIME VEHICLE POSITION DETERMINATION USING COMMUNICATIONS WITH VARIABLE LATENCY, filed Mar. 11, 2008, the contents of which are hereby incorporated by reference.

FIELD OF THE APPLICATION

The present application relates to determining vehicle position in electronic toll collection system and, in particular, determining vehicle position in an electronic toll collection system employing a wide area communications protocol.

BACKGROUND

In Electronic Toll Collection (ETC) systems, Automatic Vehicle Identification (AVI) is achieved by the use of Radio Frequency ("RF") communications between roadside readers and transponders within vehicles. Each reader continuously emits a coded identification signal and when a transponder enters into communication range and detects the reader the units transact information, in particular the unique identity of the transponder. In the USA, current AVI RF communication systems are licensed under the category of Location and Monitoring Systems (LMS) through the provisions of the Code of Federal Regulations (CFR) Title 47 Part 90 Subpart M.

The reader is typically connected to another controller, herein referred to as a Roadside Controller, which is also connected to a vehicle detector and an imaging system which work in association with the AVI RF system to permit all vehicles passing through the toll coverage to be detected, classified, and identified in order to permit the operator of the ETC system to apply appropriate charges to the owner of the vehicle. Those vehicles not equipped with transponders are typically photographed and the license plate numbers are analyzed to identify the vehicle. In ETC systems, it is generally necessary to determine in which lateral position a vehicle is traveling when it reaches the point of toll. For example, it is often necessary to separate vehicles equipped with transponders from vehicles without transponders and associate video images with vehicles that are not equipped. In other systems, the lanes may be equipped with physical barriers that will only be opened on valid transponder identification for the specific lanes. In order to do so in any of these systems, the ETC system must clearly identify where the subject vehicle is located within the multiple zones of coverage of the system.

Current ETC systems can be classed as either lane-based or open-road.

In a lane-based system, the reader controls reader channels, each of which corresponds to RF coverage of an individual vehicle lane, which will then communicate with vehicles in individual lanes. The RF communication coverage area of each channel is often referred to as the capture zone. In a lane-based system the capture zone is typically 1.2 to 2.4 meters (4-8 feet) long and 3 meters (10 feet) wide. Lane-based systems also require that the vehicles be laterally constrained to the lanes through appropriate physical measures such as barriers between lanes. Thus when a vehicle with a transponder passes through a capture zone, the vehicle location is easily associated with the specific lane at that instant in time, and the short length of the zone allows for accurate timing alignment with the vehicle detection imaging systems.

Open-road systems in contrast allow traffic to free flow without impediment of lane barriers. Thus vehicles may be laterally located anywhere over multiple lanes of traffic, for example they can be mid-way between two lanes, and moreover need not be traveling parallel to the lanes, for example they can be changing lanes as they pass through the toll area.

Current open-road toll ETC systems can be classed either as open-lane-based or locator-based.

Open-lane-based systems employ RF capture zones similar in size to the lane-based systems but the systems employ more channels than lanes to provide overlapping or staggered RF capture zones over multiple lanes. The reader analyses detections from multiple capture zones to determine to which zone to assign the vehicle location. An example open-lane-based ETC system in described in U.S. Pat. No. 6,219,613, which is owned in common herewith.

Locator-based systems in contrast use wide-area communications, where a single RF channel spans multiple traffic lanes in width and is also much longer than a lane-based system. The capture zone of locator-based systems is typically 16.8 meters (55 feet) wide by 36.6 meters (120 feet) long. One major difference is that, unlike the lane-based approaches, multiple transponders can be simultaneously present in the coverage area. The locator-based system typically uses two receivers, each with a separate antenna, to simultaneously receive signals from a transponder. By comparison of the properties of the signal received at the two receivers, such as amplitude difference, phase difference or time difference of arrival, and knowledge of the RF communication timing, the system can determine the vehicle location to a precision equal to that to the lane-based systems. The locator antenna system may operate in accord with the system described in U.S. Pat. No. 6,025,799, which is owned in common herewith.

One issue for ETC systems is synchronizing the RF communication system and the vehicle detection system. If the communication occurs too early or too late, then it is possible to wrongly associate another vehicle with the communicating transponder. Additionally, vehicle positions relative to the lanes can be changing as vehicles pass through the toll area, so that it is necessary that a communication occurs with the moving vehicle while the car is close to the vehicle detection point. At 70 mph (102 feet per second) a vehicle will typically only remain in the lane-based capture zone for less than 60 ms while in a locator-based system this time increases to around 1200 ms. It is noted that a toll transaction may require multiple information packets to be exchanged between the reader and the transponder, and this must occur during that short time.

To ensure this synchronization, current North American toll systems employ Time Division Multiple Access (TDMA) RF communications at nominally 900 MHz. Each information packet exchange—transmission of data and its acknowledgement—occurs over a period of a few milliseconds. The TDMA structure allows the reader to interrogate specific transponders at time instants controlled by the reader, thereby allowing the reader to synchronize the data exchange with the transponder with the timing of the other roadside equipment.

The potential exists to perform the RF communications with a non-TDMA, more general purpose wide area communication system. In particular, in the US, the CFR 47 provisions allow for vehicular and roadside communications under Parts 90 and 95 in the category Dedicated Short Range Communications (DSRC) Service at nominally 5.9 GHz using an extension of the IEEE 802.11 communication standard as specified currently under ASTM E2213. However, unlike LMS, DSRC communications permitted are not restricted to location and monitoring functions and can extend up to 400 m or more in range from the communication antenna.

The DSRC communication system is intended for sharing for multiple applications and, while 802.11 based communication systems support high data rates, there are inherent latencies in the communications and variable communications delays.

It would be advantageous to provide for an ETC system and method capable of vehicle detection employing a wide area communications protocol, in particular one with variable communication delays

BRIEF SUMMARY

In one aspect, the present invention provides a method for tracking a vehicle in an electronic toll collection (ETC) system. The vehicle has a transponder configured to communicate with a roadside processor using a wide area RF communications protocol when in a coverage area of the system. The coverage area includes a portion of a multilane roadway. The method includes receiving at least one RF signal from the transponder, the at least one RF signal containing position data and a recorded time, wherein the recorded time is a time at which the position data was recorded by the transponder; and predicting the position of the vehicle at a future time based on the position data and the recorded time.

In another aspect, the present invention provides an electronic toll collection (ETC) system for conducting toll transactions with a vehicle traveling in a multilane roadway. The vehicle has a transponder configured to communicate using a wide area communications protocol. The system includes an RF communications unit and antenna having a coverage area encompassing a section of the multilane roadway through which the vehicles travel; a wide area reader configured to communicate with the transponder via the RF communications unit and antenna, the wide area reader including a vehicle position predictor configured to receive at least one RF signal from the transponder, the at least one RF signal containing position data and a recorded time, wherein the recorded time is a time at which the position data was recorded by the transponder, and wherein the vehicle position predictor is configured to predict the position of the vehicle at a future time based on the position data and the recorded time; and a roadside controller for conducting ETC transactions, wherein the roadside controller is adapted to receive data from the vehicle position predictor and to conduct an ETC transaction in relation to the vehicle.

In one aspect the predictor may be used to regularly predict the position of all vehicles that have provided position data so that when a detection is reported by the vehicle detection system the predicted positions are compared with the detection information to associate a vehicle with that detection. In an alternative embodiment, when a detection is reported the predictors of the vehicles are immediately computed for the instance in time of corresponding to the detection time and again a vehicle is associated with the detection.

In one embodiment, the at least one RF signal includes a first signal containing first position data at a first time and a second signal containing second position data at a second time. With two or more position reports from the transponder, the vehicle position predictor is configured to determine likely future position of the vehicle.

In another embodiment, instead of multiple position reports, the vehicle may contain a system which provides both position and trajectory (speed and direction) information, and a minimum of one vehicle communication is required containing the position and trajectory information and the time at which it was recorded. The roadside predictor can then compute predicted position using this data set.

In still another embodiment, the vehicle may contain a system which includes a position tracking filter similar to the filter in the vehicle position predictor in use at the roadside. Instead of positional data and/or positional data and trajectory information, the transponder transmits the state variables computed in its filter along with the time at which those variables were valid. These variables are then loaded into a filter in the vehicle position predictor on the roadside and again the roadside predictor can then compute predicted position.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show embodiments of the present invention, and in which.

Similar reference numerals are used in different figures to denote similar components.

DESCRIPTION OF SPECIFIC EMBODIMENTS

Figure 1:
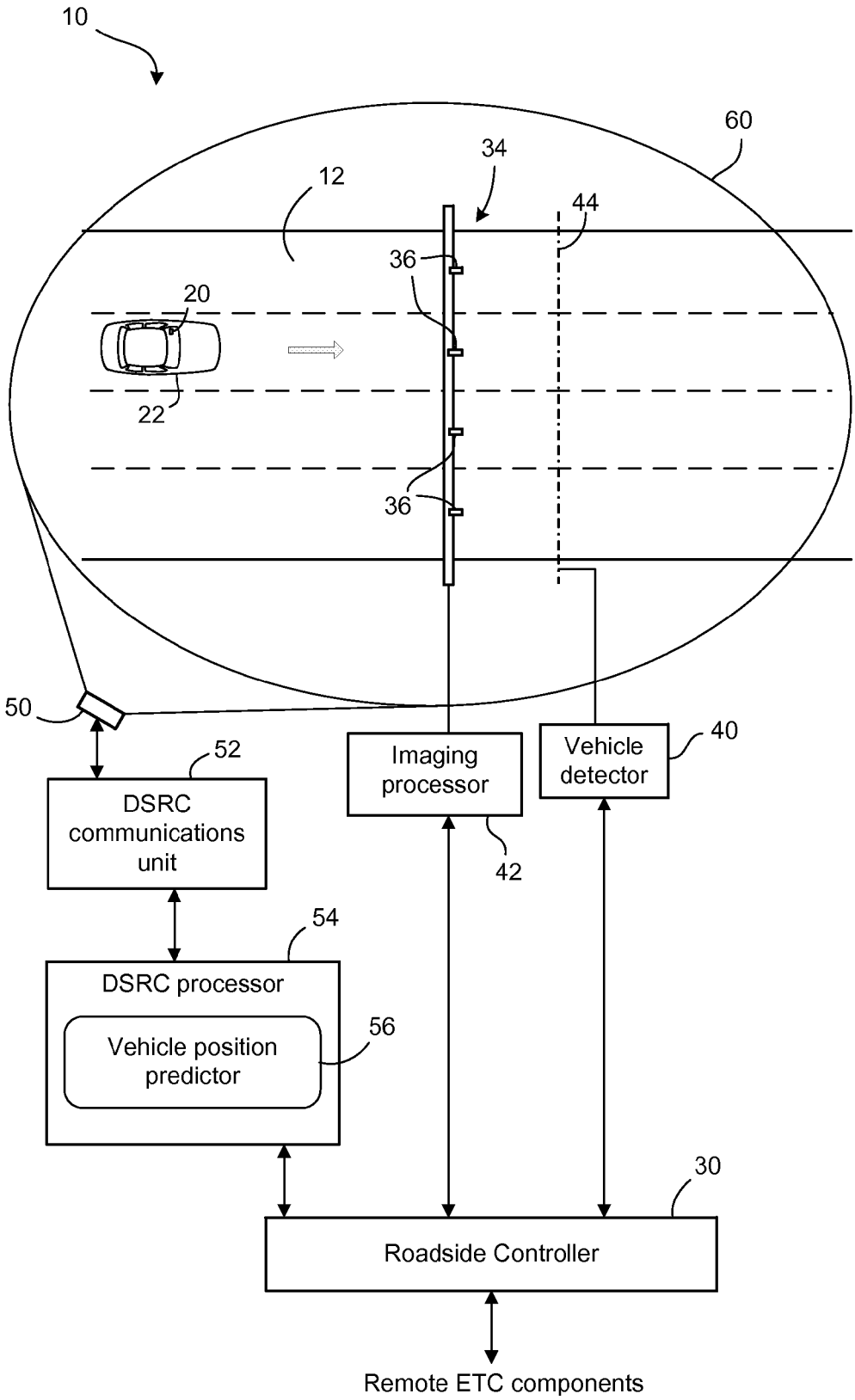
FIG. 1 shows, in block diagram form, a wide area electronic toll collection (ETC) system.

Reference is first made to FIG. 1, which shows, in block diagram form, an electronic toll collection (ETC) system 10 which uses wide-area communications. The ETC system is employed in connection with a roadway 12 having one or more lanes for vehicular traffic. The arrow indicates the direction of travel in the roadway 12. For diagrammatic purposes, a vehicle 22 is illustrated in the roadway 12. In some instances, the roadway 12 may be an access roadway leading towards or away from a toll highway. In other instances, the roadway 12 may be the toll highway.

The ETC system 10 employs wide area communications for communicating between roadside equipment and transponders mounted within the vehicles and the roadway. Vehicle 22 is shown in FIG. 1 with a transponder 20 mounted to the windshield. In other embodiments, the transponder 20 may be mounted in other locations. The ETC system 10 includes an antenna 50 having characteristics that define a wide area coverage area 60 that encompasses the portion of the roadway 12 shown in FIG. 1. The size of the coverage area 60 means that more than one vehicle maybe present within the coverage area 60 at any one time.

The ETC system 10 may employ any communications protocol suitable for wide area vehicular and roadside communications. In one example embodiment, the ETC system 10 employs Dedicated Short Range Communications (DSRC) Service at nominally 5.9 GHz using an extension of the IEEE 802.11 communications standard as specified currently under ASTM E2213. This communications protocol is intended for vehicular and roadside communications. DSRC communications may be employed for a number of applications, including electronic toll collection. The DSRC communications standard supports communication ranges of 400 meters or more. This can result in a number of DSRC-equipped vehicles/transponders communicating in the same radio space for a number of different applications. As a result, there is great potential for interference and competition for access to the bandwidth. In some cases, the DSRC communications system may be employed for safety features and other high priority applications that will be given preferential access. In addition, potential DSRC transmitters contend for channel access using a carrier sense multiple access/collision avoidance (CSMA/CA) method. Moreover, the specific communications channel may not be continuously available. For example, under the IEEE 1609.4 extensions develop specifically for DSRC using 802.11, time multiplexing is performed between different frequency channels on time frames in the order of every 50 ms. As a result of all these factors, there can be considerable and variable delay between generating a message relating to ETC communications on the transponder 20 and its reception at the antenna 50. As will be described below, the ETC system 10 must account for this variable delay in receiving transmissions from transponders 20 within the coverage area 60. The delay in receiving transmissions from the transponders 20 is particularly problematic for determining the position of the vehicle 22 at any point in time.

Referring still to FIG. 1, the antenna 50 is connected to a DSRC communications unit 52. The DSRC communications unit 52 receives and demodulates signals from the antenna 50 and modulates outgoing signals to the antenna 50 with data for transmission to the transponders 20 in the coverage area 60. The DSRC communications unit 52 operates under the control of a DSRC processor 54. The DSRC processor 54 may include a microprocessor, microcontroller, associated memory, application specific integrated circuit, or any combination thereof. The DSRC processor 54 may be configured to operate in accordance with one or more software modules configured to implement the functions described herein. The suitable programming and configuration of the DSRC processor 54 will be within the understanding of one or ordinary skill in the art having regard to the description herein.

Among the software modules executed by the DSRC processor 54 within the ETC system 10 may be a vehicle position predictor 56. The vehicle position predictor 56 is adapted to receive positional information from the transponder 20 over the DSRC communications channel and to determine the likely future position of the transponder 20 and its associated vehicle 22 based on that received information. Further details regarding position prediction are set out below.

The ETC system 10 further includes an enforcement system. The enforcement system may include a vehicle imaging system, indicated generally by the reference numeral 34. The vehicle imaging system 34 is configured to capture an image of a vehicle within the roadway 12 if the vehicle fails to complete a successful toll transaction. The vehicle imaging system 34 includes cameras 36 mounted so as to capture the rear license plate of a vehicle in the roadway 12. A vehicle detector 40 defines a vehicle detection line 44 extending orthogonally across the roadway 12. The vehicle detector 40 may include a gantry supporting a vehicle detection and classification (VDAC) system to identify the physical presence of vehicle passing below the gantry and operationally classifying them as to a physical characteristic, for example height. In some example embodiments, the vehicle detector may include loop detectors within the roadway for detecting a passing vehicle. Other systems for detecting the presence of a vehicle in the roadway 12 may be employed.

The imaging processor 42, vehicle detector 40, and DSRC processor 54 are all connected to and interact with a roadside controller 30. The roadside controller 30 also communicates with remote ETC components or systems (not shown) for processing toll transactions. The roadside controller 30 receives data from the DSRC processor 54 regarding the transponder 20 and the presence of the vehicle 22 in the roadway 12. The roadside controller 30 initiates a toll transaction which, in some embodiments, may include communicating with remote systems or databases. On completing a toll transaction, the roadside controller 30 instructs the DSRC processor 54 to communicate with a transponder 20 to indicate whether the toll transaction was successful. The transponder 20 may receive a programming signal advising it of the success or failure of the toll transaction and causing it to update its memory contents. For example, the transponder 20 may be configured to store the time and location of its last toll payment or an account balance.

The roadside controller 30 further receives data from the vehicle detector 40 regarding vehicles detected at the vehicle detection line 44. The roadside controller 30 controls operation of the enforcement system by coordinating the detection of vehicles with the position of vehicles having successfully completed a toll transaction. For example, if a vehicle is detected in the roadway at the vehicle detection line 44 in a particular laneway, the roadside controller 30 evaluates whether it has communicated with a vehicle that has completed a successful toll transaction and whose position corresponds to the position of the detected vehicle. If not, then the roadside controller 30 causes the imaging processor 42 to capture an image of the detected vehicle's license plate.

It will be appreciated that the roadside controller 30 must have reasonably accurate information regarding the position of each of the vehicles in the roadway 12 for which it is conducting toll transactions. Without accurate and timely positional information regarding each of the vehicles, the roadside controller 30 is unable to correlate the position of those vehicles with vehicles detected by the vehicle detector 40. In wide area communication systems having variable latency, such as DSRC, conventional approaches to tracking vehicle location in an ETC system are inapplicable. Accordingly, the present ETC system 10 includes the vehicle position predictor 56 for supplying the roadside controller 30 with positional information regarding each of the vehicles in the roadway 12 equipped with a DSRC-capable transponder.

The transponder 20 is configured to transmit positional information together with a time stamp. The positional information may be based on external inputs received by the transponder 20 from other vehicle systems, such as a GPS communication system or an inertial navigation system. Various other system or devices for obtaining positional and/or trajectory data with regard to the vehicle will be appreciated by those of ordinary skill in the art. In some instances, the position determination component may form a part of the vehicle on-board diagnostics network, or other in-vehicle system. In yet other instances, the position determination component may be integrated with the transponder 20.

The DSRC processor 54 may instruct the transponder 20 to provide time stamped positional information on a regular basis while in the coverage zone 60. When a report is received by the DSRC processor 54 over the DSRC communications channel from the transponder 20, it is received at a time T+D, where the time T is the time at which the report was generated by the transponder 20 and time stamped and D is the delay in accessing and transmitting the report over the DSRC communications channel. Using multiple reports from the transponder 20 the vehicle position predictor 56 is capable of determining the position of the vehicle at two recent points in time. The vehicle position predictor 56 may be configured to determine the speed and/or trajectory of the vehicle and thus, to predict its probable future location. In some embodiments, the transponder 20 may be configured to send speed and/or trajectory data with the positional data, and in this case only one report is required by the vehicle position predictor to start producing predictions. In one embodiment, the received data from two or more vehicle position reports are fed into a position estimation algorithm, for example one based on Kalman filtering techniques. Positional data is associated with its recorded time stamp rather than the time it was received by the DSRC processor 54. As additional reports are received from the transponder 20, the vehicle position predictor 56 may update/refine its prediction of the current and future position of the vehicle 22. In some embodiments, the transponder 20 may contain a similar Kalman filter, for example in an inertial navigation system, and is configured to send the state variables computed in the filter. In this case only one report is required by the roadside vehicle position predictor to start producing predictions.

It will be appreciated by those skilled in the art that it is not necessary that the reports from a vehicle be evenly spaced in time, but rather that the time from the last report be sufficiently short that the vehicle predictor error is small.

The interactions with the transponder 20 and the DSRC processor 54 may include a synchronization process, to ensure that the transponder 20 and the roadside DSRC processor 54 are using a common time base. For example, the DSRC standard requires communicating units to synchronize to Universal Coordinated Time (UTC) to employ many of the communication capabilities. The synchronization may occur based on GPS receivers, a source of UTC, in each of the transponder 20 and the DSRC processor 54 or associated roadside DSRC system equipment. In one example embodiment, time synchronization protocols defined within the DSRC standard may be employed to obtain sync. In this embodiment the roadside unit is considered a time master and it timestamps its messages at the actual time of transmission and the receiving unit adjusts its time source to adopt the timing from the messages it receives at the time of reception. This process is performed at the physical layer. It will be appreciated that despite variable delays and latencies in the communication system, performing time sync at the physical layer avoids those delays and latencies since the timing is synchronized when a message is actually transmitted and received.

The DSRC processor 54 may provide the roadside controller 30 with predicted positional information regarding vehicles on a continuous or periodic basis. In some embodiments, the DSRC processor 54 may provide the roadside controller 30 with positional information regarding vehicles upon request by the roadside controller 30, for example when the roadside controller 30 detects a vehicle at the vehicle detection line 44.

Those of ordinary skill in the art will appreciate that there a number of algorithms that may be employed by the vehicle position predictor 56 to refine its estimate of the current or future position of the vehicle 22 based on two or more reports of vehicle position in recent time.

In an embodiment in which the predicted positional information is used by the roadside controller 30 for the purposes of triggering enforcement, the DSRC processor 54 and, in particular, the vehicle position predictor 56, may be configured to calculate the likely time at which the vehicle 22 will reach the vehicle detection line 44 and the probable lane in which the vehicle 22 will be located when it reaches the vehicle detection line 44. The roadside controller 30 may then use this information to determine whether vehicles detected by the vehicle detector 40 correspond to vehicles with which the ETC system 10 has conducted a successful toll transaction. It will be appreciated that the DSRC processor 54 may continuously provide updated predicted timing and position information to the roadside controller 30 or, may only provide the roadside controller 30 with information regarding vehicle location at or slightly in advance of the time at which the vehicle 22 is predicted to reach the vehicle detection line 44. It will also be appreciated that the information provided to the roadside controller 30 by the DSRC processor 54 regarding the predicted position of the vehicle includes vehicle identification information, such as a transponder ID, to allow the roadside controller 30 to correlate the position information with information regarding successful toll transactions.

In another embodiment, the DSRC processor 54 may employ the vehicle position prediction to determine when to report the presence of the vehicle to the roadside controller 30 for a purpose of initiating a toll transaction. In circumstances in which coverage area 60 is sufficiently large to capture areas in which vehicles may be traveling outside of the roadway 12, it may be advantageous to initiate toll transactions only for those vehicles that report their position as being with a given sub-area of the coverage area 60, namely within the upstream lanes of the roadway 12 approaching the toll area and vehicle detection line 44. For example, the coverage area 60 may be sufficiently large to detect transponders affixed to vehicles traveling in side roads, adjacent lanes of traffic traveling in the opposite direction, nearby parking lots, or other areas outside the roadway 12. In such an embodiment, the DSRC processor 54 evaluates the positional information received in one or more reports from the transponder 20 to determine whether the vehicle 22 is located in the appropriate sub-area of the coverage area 60, namely in one of the upstream lanes of the roadway 12. If the vehicle is detected to be in the sub-area, then the DSRC processor 54 reports the presence of the vehicle to the roadside controller 30, which then initiates a toll transaction.

In another embodiment, the DSRC Processor 54 may be triggered to compute vehicle position predictions when a detection is reported by the vehicle detector 40 of a vehicle at the vehicle detection line or area and the lane in which it occurs. In this embodiment, the DSRC Processor 54 computes a prediction of the position at the instance in time of detection of all the vehicles it is tracking and reports the most likely vehicle to have triggered the detector.

Although the embodiment shown in FIG. 1 illustrates the vehicle position predictor 56 as part of the DSRC processor 54, it will be appreciated that some or all of the vehicle prediction function may be incorporated into the roadside controller 30. In such an embodiment, the DSRC processor 54 may pass positional information directly to the roadside controller 30.

Figure 2:
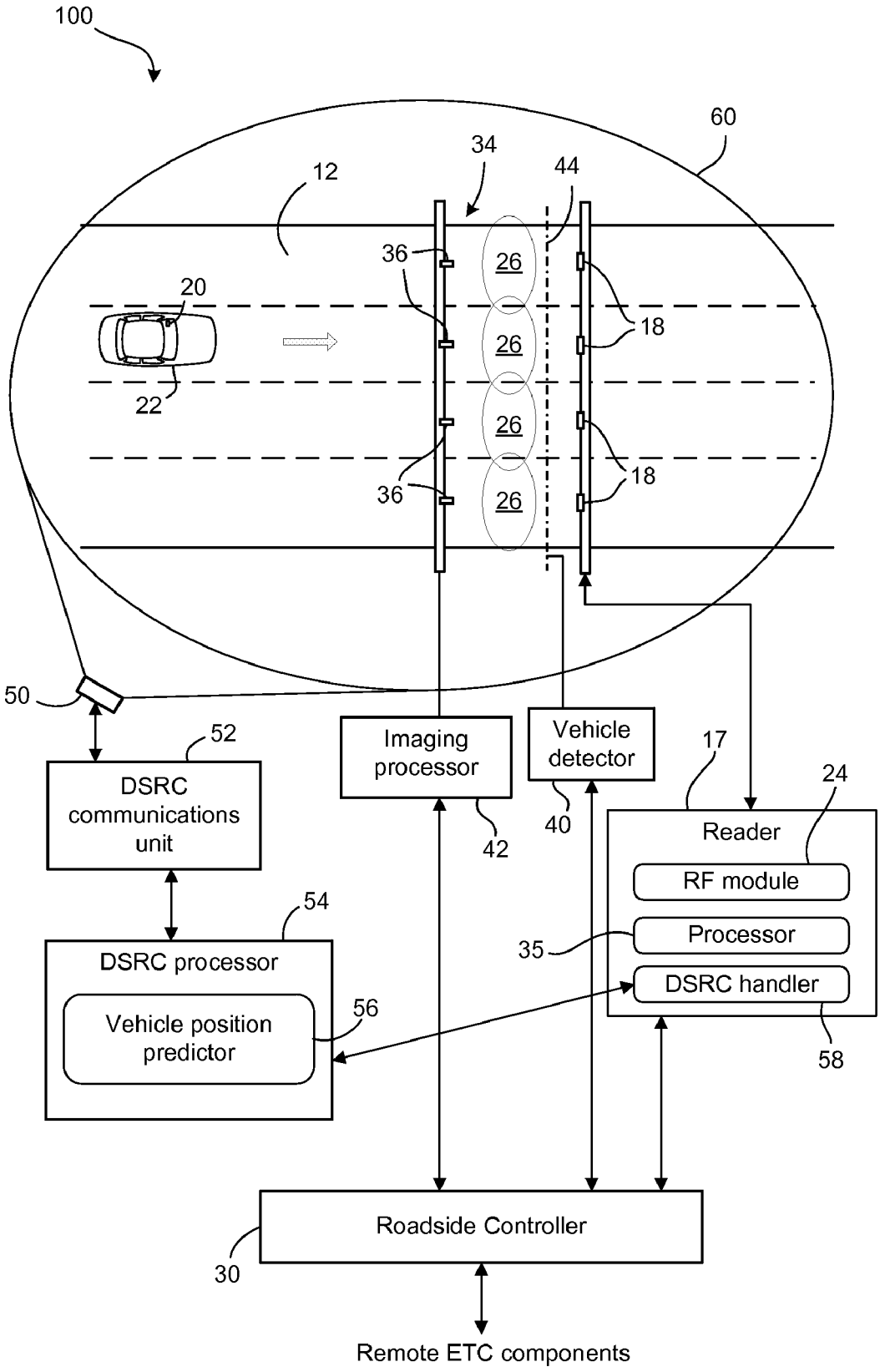
FIG. 2 shows, in block diagram form, another embodiment of a wide area ETC system.

Reference is now made to FIG. 2, which diagrammatically shows another embodiment of an ETC system 100 employing a wide area communications protocol. The ETC system 10 shown in FIG. 1 employed DSRC communications for all toll transactions. The ETC system 100 shown in FIG. 2 includes a legacy portion configured to conduct toll transactions using a legacy ETC protocol.

The legacy ETC system includes antennas 18, each of which is connected to an automatic vehicle identification (AVI) reader 17. The reader 17 processes signals that are sent and received by the antennas 18. The reader 17 includes a processor 35 and a radio frequency (RF) module 24.

The antennas 18 are directional transmit and receive antennas which, in the illustrated embodiment, are oriented to define a series of coverage zones 26 extending across the roadway 12 in an orthogonal direction. The arrangement of coverage zones 26 define the legacy communication zone within which toll transactions are conducted using the legacy ETC protocol.

The legacy system may operate, for example, within the industrial, scientific and medical (ISM) radio bands at 902-928 MHz. For example, the legacy ETC system may conduct communications at 915 MHz.

In the legacy ETC system, vehicles are first detected when they enter the coverage zones 26 and a transponder within the vehicle responds to a trigger signal broadcast by one of the antennas 18. As the vehicle traverses the coverage zones 26, the transponder 20 communicates with the reader 17 one or more times and the roadside controller 30 conducts a toll transaction. As the vehicle leaves the coverage zone 26, the reader 17 or roadside controller 30 determines the vehicle's position within the roadway 12. This allows the roadside controller 30 to coordinate detection of the vehicle by the vehicle detector 40 with known vehicles in the roadway. It may be noted that only one vehicle is present in a coverage zone 26 at any one time.

In some cases, in a legacy ETC system the vehicle position is determined based on a voting algorithm that counts the number of handshakes between the transponder 20 and each antenna 18. Based on the relative allocation of handshakes between the transponder 20 and the various antennas 18, the roadside controller 30 is able to determine the likely position of the vehicle and the roadway 12. This is sometimes referred to as a "lane assignment".

In the ETC system 100 shown in FIG. 2, the DSRC processor 54 and, in particular, the vehicle position predictor 56, communicate with a DSRC handler 58 in the reader 17. The DSRC handler 58 is configured to receive information from the DSRC processor 54 regarding DSRC-capable transponders detected within the coverage area 60. The DSRC-capable transponders would not be detected by the legacy ETC system when they enter the coverage zones 26. Accordingly, the DSRC processor 54 supplies the transponder information necessary for conducting toll transactions with the DSRC-capable transponders to the DSRC handler 58. Moreover, the vehicle position predictor 56 supplies the DSRC handler 58 with positional information that enables the DSRC handler 58 to determine when the vehicle with the DSRC-capable transponder enters the communication zone defined by the coverage zones 26. The DSRC handler 58 may then generate messages to the roadside controller 30 that mimic communications from a legacy transponder. In this manner, the roadside controller 30 need not distinguish between legacy transponders and DSRC-capable transponders. All communications relating to toll transactions pass through the reader 17 and are treated by the roadside controller 30 as legacy communications. In this regard, the DSRC handler 58 supplies the roadside controller 30 with positional information similar to that which would have been received in the legacy system. For example, in a legacy ETC transaction, the reader 17 and, in particular the processor 35, may include a position determination module for assigning a lane position to a vehicle based on the voting algorithm. The lane assignment may occur as the vehicle traverses the coverage zones 26 or as the vehicle leaves the coverage zones 26. This determination is transmitted from the processor 35 to the roadside controller 30 and the roadside controller 30 compares this data with vehicle detection data from the vehicle detector 40. On this basis, the roadside controller 30 controls the imaging processor 42 in order to capture images of vehicles that fail to conduct a toll transaction.

The DSRC handler 58 may make a lane determination on the basis of the vehicle position prediction made by the vehicle position predictor 56. Moreover, the DSRC handler 58 may time its messages to the roadside controller 30 based on the predicted position of the vehicle determined by the vehicle position predictor 56. For example, the DSRC handler 58 may initially notify the roadside controller 30 of the presence of the transponder in the coverage zones 26 at a time when the vehicle position predictor 56 estimates that the vehicle will reach the coverage zones 26. This allows the DSRC handler 58 to supply a message to the roadside controller 30 as though the transponder were first detected when it reached the coverage zones 26. Thereafter, the DSRC handler 58 may send the roadside controller 30 a lane assignment message at approximately the same time when a lane assignment would have occurred under the legacy ETC protocol. Again, the vehicle position predictor 56 may determine a time at which the vehicle would be leaving the coverage zones 26 and the DSRC handler 58 may time its lane assignment message to the roadside controller 30 on this basis if the legacy ETC system is adapted to make lane assignments as the vehicle leaves the coverage zones 26.

In the embodiment shown in FIG. 2, the information received by the DSRC processor 54 from the DSRC-capable transponder is similar to that described in connection with FIG. 1. For example, in one embodiment, the DSRC-capable transponder periodically sends a report of its position together with a time stamp reflecting when the position was determined. In another embodiment, the transponder may also send speed and/or trajectory data. The speed and trajectory data may be derived from onboard diagnostic systems in the vehicle. Further the speed and trajectory information may be encoded into the form of state variables from an on-board position tracking filter.

Figure 3:
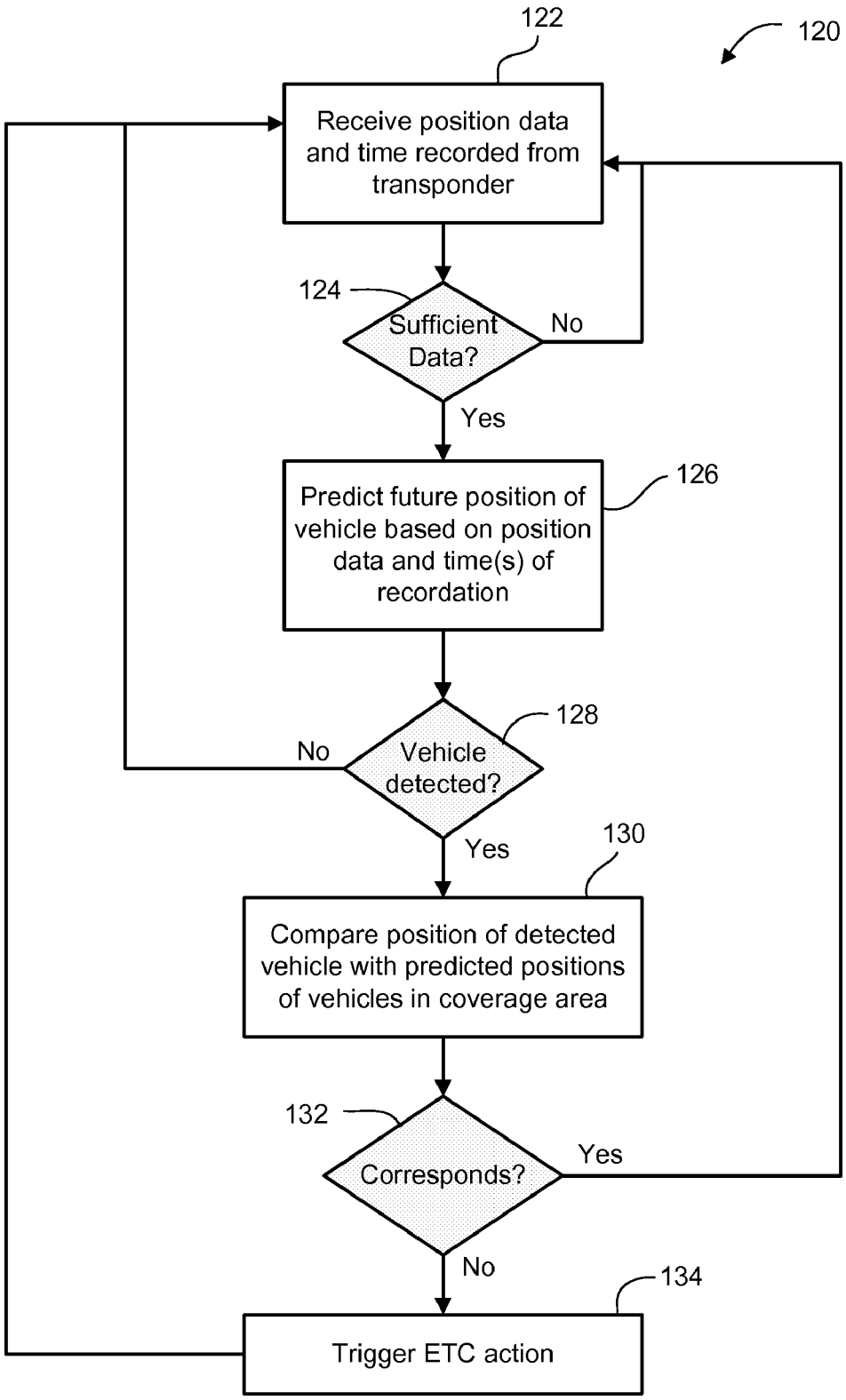
FIG. 3 shows, in flowchart form, a method for determining the position of a vehicle in a wide area ETC system.

Reference is now made to FIG. 3, which shows, in flowchart form, a method 120 for determining vehicle position in a wide area ETC system. The method 120 is applicable to an ETC system employing a wide area communications protocol. Such an ETC system has an antenna coverage area too large to permit the estimation of vehicle position on the basis of detecting a response. In many embodiments, the coverage area of a single antenna may encompass multiple lanes and span areas outside the roadway itself. The method 200 is applicable irrespective of whether the ETC system includes both wide area communications and legacy ETC communications or whether the ETC system employs wide area communications only.

The method begins at step 122 with the receipt of position data and a time stamp associated with generation of the position data from a transponder within the coverage area. As noted above, in some embodiments, the transponder may also report speed or other data relating to the likely future position of vehicle, such as whether the accelerator or brake are currently depressed, and to what degree. The report received in step 122 is generated at a time T and is received a time T+D, where D is the delay in accessing the DSRC communications channel and communicating the report from the transponder 20 to the DSRC communications unit 52.

In step 124, the DSRC processor 54 assesses whether it has sufficient data for the purpose of position prediction. In a case where the transponder 20 provides positional coordinates and a recorded time, the DSRC processor 54 may require at least two such reports before it is capable of predicting future position. In a case in which the first report contains both positional coordinates and trajectory data, the DSRC processor 54 may be capable of predicting future position beginning with the first report. Different reports from the same transponder may be correlated on the basis of the transponder identification number, which is included in each report. If, in step 124, it is determined that there is insufficient data from a transponder entering the coverage area 60, then the method 120 returns to step 122 to await a further report. The DSRC processor 54 may send a response to the transponder 20 requesting that the transponder 20 send regular periodic reports of its position. In some embodiments, a first report from a transponder may not include positional data until requested by the DSRC processor 54. Thereafter, the DSRC processor 54 may instruct the transponder 20 to send regular positional data. Alternatively the DSRC processor 54 may instruct the transponder 20 to send an update when the DSRC processor 54 believes the current predictor information to be inaccurate, for example due to time elapsed since the last update.

If the report received in step 122 is considered to contribute sufficient data for the vehicle prediction process, for example the second or subsequent position report for the transponder, then the method 120 proceeds to step 126, wherein the vehicle position predictor 56 attempts to predict the future position of the transponder/vehicle based on the position data and the time(s) at which the positional data was recorded. As noted above, the vehicle position predictor 56 includes a position prediction algorithm. The algorithm may be based on Kalman filtering techniques, or other such mechanisms. In some instances, the algorithm may take into account data regarding speed or other data that may influence the future position of the vehicle.

In some embodiments, step 126 may include calculation of a current position for the vehicle. In some embodiments, step 126 may include calculating the likely vehicle position at various future time intervals stretching forward, perhaps, a few seconds. In one embodiment, step 126 includes determining when the vehicle is likely to reach the vehicle detection line 44 and determining its lane position at the time it reaches the vehicle detection line 44. In an embodiment in which the vehicle position is required for enforcement purposes, this latter information regarding the likely lane position of a vehicle and the time at which it will likely reach the vehicle detection line may be forwarded to the roadside controller 30.

Following step 126, an assessment is made as to whether a vehicle has been detected by the vehicle detector 40. If not, the method 120 cycles back to step 122 to await receipt of further reports or new reports from new transponders. It will be appreciated that the ETC system is configured to track more than one transponder and vehicle within the coverage area 60, and to receive multiple reports from the various transponders and to track their respective positions in the area 60.

If a vehicle has been detected by the vehicle detector 40, then, in step 130, the position of the vehicle detected by the vehicle detector 40 at the current time is compared with the predicted positions of vehicles in the coverage area 60 at the current time. In this regard, the roadside controller 30 may consult information provided by the vehicle position predictor 56 regarding vehicles predicted to reach the vehicle detection line 44 at or around the current time and the predicted lane assignment for those vehicles. In step 130, the roadside controller 30 makes an assessment as to whether the detected vehicle corresponds to one of the vehicles tracked by the vehicle position predictor 56 and predicted to be in approximately the same position.

In one embodiment the system detection will identify a geographic line or area, normally generally orthogonal to the roadway, and will report on any vehicle crossing this line or entering this area. The vehicle predictors will be used to predict the time at which each vehicle is expected to cross the line or enter the area and the vehicle with the predicted time closest to the reported detection instant is associated with the detection.

In another embodiment, the system may contain multiple detectors and will associate a unique geographic point with each detector, such as the center of a lane. Then the system can compute the estimated distance of each vehicle predicted position from each detection point. The vehicle with the closest predicted distance at the time of detection to the triggered detector will then be associated with the detection point. This basic association process may be enhanced by including weighting based on the estimated error on each position estimator; the error being based on, for example, the time elapsed since the last report from the vehicle and/or quality metrics provided by the vehicle on the last report it provided. Such quality reports can be based on for example the rms error estimate reported by the GPS or inertial navigation system. Further the assessment may be performed in a joint estimation process where the vehicle associations for multiple detections are solved together for multiple detections that occur over a short time interval, as may occur in systems with multiple traffic lanes.

In step 132, the roadside controller 30 makes a determination as to whether the detected vehicle corresponds to one of the vehicles tracked by the vehicle position predictor 56 and, if so, returns to step 122 to continue monitoring transponders in the area 60. In some embodiments, the correlation of a vehicle to the detection may be used to initiate another action, for example the raising of a barrier associated with the lane to permit the vehicle to proceed. In some embodiments, this includes the roadside controller 30 causing the imaging processor 42 to capture an image of the rear of the vehicle detected in the roadway 12, to provide a photographic record of the vehicle that is passing through the detection region.

If the detected vehicle does not correspond to one of the tracked vehicles, then the roadside controller 30 triggers enforcement in step 134. In some embodiments, this includes causing the imaging processor 42 to capture an image of the rear of the vehicle detected in the roadway 12. In other embodiments, it may involve other measures in addition to or instead of image capture. For example, an alert or message may be sent to an enforcement vehicle.

Figure 4:
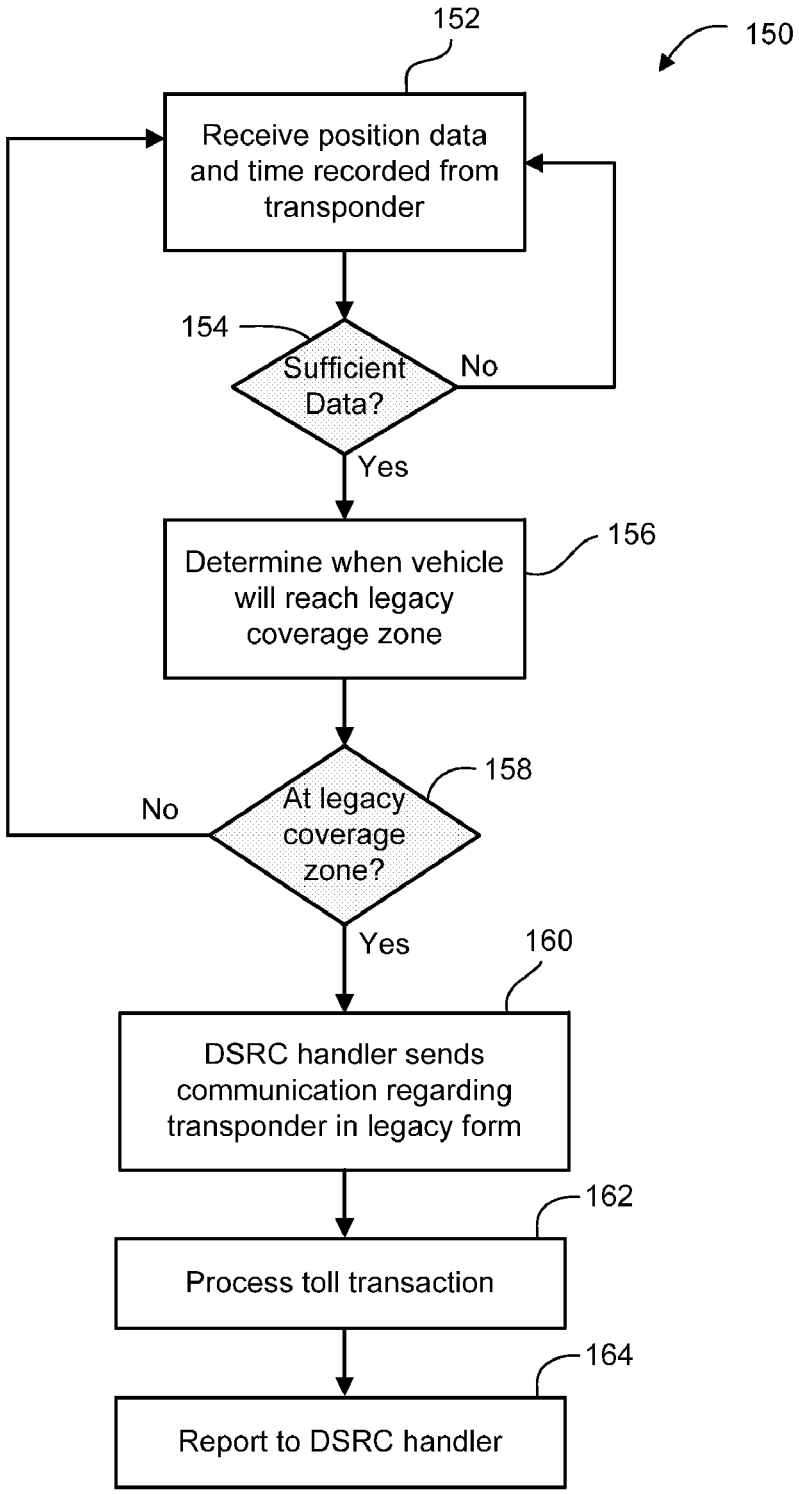
FIG. 4 shows, in flowchart form, a method of integrating wide area ETC communications within a legacy ETC system.

Reference is now made to FIG. 4, which shows, in flowchart form, a method 150 for determining vehicle position in a wide area ETC system. The method 150 is applicable to an ETC system incorporating both a wide area communications protocol and a legacy ETC protocol. In such an ETC system, a vehicle may be equipped with either a legacy ETC transponder configured to communicate with the ETC system at 915 MHz using the legacy ETC protocol, or a DSRC-capable transponder configured to communicate with the ETC system using the wide area communications protocol. The method 150 relates to communications from the DSRC-capable transponder.

The method 150 begins in step 152 wherein position data and the time at which the position data was recorded by the transponder are received by the DSRC processor 54 in a report broadcast by the transponder 20. An assessment is made in step 154 as to whether the DSRC processor 54 has sufficient data for the purpose of position prediction. Thus, for example if the report contains solely position coordinates data, then two or more reports may be required before there is sufficient data to predict future positions. In this case, if the report is the first such report from the transponder 20, the DSRC processor 54 will need to await receipt of a further report. Alternately, if the report contains speed and trajectory data then the DSRC processor 54 has sufficient data to make a position prediction based on a single report.

If there is insufficient information, then the method 150 returns to step 152 to await receipt of a further report from that transponder 20. If sufficient data has been received, then in step 156 the vehicle position predictor 56 determines when the vehicle 22 will likely reach the legacy coverage zone defined by the coverage zones 26. The vehicle position predictor 56 also assesses the lane in which vehicle 22 is located when it reaches the coverage zones 26.

In step 158, an assessment is made as to whether the vehicle 22 has likely reached the legacy coverage zone based on the predictions made by the vehicle position predictor 56. If not, then the DSRC processor 54 and vehicle position predictor 56 await further reports from the transponder 20 in order to refine the predictions. If, in step 158, it is determined that the vehicle 22 has likely entered the coverage zone defined by the legacy coverage zones 26, then the DSRC handler 58 sends a message to the roadside controller 30. The message mimics the messaging normally used by the reader 17 in reporting detection of a new transponder in a coverage zone 26. The DSRC handler 58 also sends the roadside controller 30 lane assignment information specifying the position of the vehicle 22 in the roadway 12. Step 160 reflects the messaging sent by the DSRC handler 58 so as to mimic legacy ETC communications between the reader 17 and the roadside controller 30 as though the DSRC transponder 20 had entered the legacy ETC zone before initiating communications. The roadside controller 30 performs a toll transaction in step 162. In step 164, the successful toll transaction is reported to the DSRC handler 58 along with programming information. The DSRC handler 58 reports this information to the DSRC processor 54, which may then take steps to program the DSRC-capable transponder 20.

It will be appreciated that the method 150 of FIG. 4 may incorporate some of the steps of the method 120 of FIG. 3 regarding the triggering of enforcement mechanisms based on vehicle detection.

It will also be appreciated that various modifications may be made to the methods 120 and 150 without affecting the overall function or operation of the methods 120 and 150.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A method for tracking a vehicle in a toll area of an electronic toll collection (ETC) system, the vehicle having a transponder to communicate with a roadside processor using a wide area radio frequency (RF) communications protocol when in a coverage area of the system, the coverage area including a section of a multilane roadway in the toll area through which vehicles travel, the method comprising:

receiving at least one RF signal from the transponder, the at least one RF signal comprising position data and a recorded time, wherein the recorded time is a time at which the position data was recorded by the transponder, and wherein the position data comprises data regarding the vehicle's position in the toll area; and predicting the position of the vehicle at a future time based on the position data and the recorded time.

2. The method claimed in claim 1, wherein receiving the at least one RF signal comprises receiving a first RF signal comprising first position data recorded at a first time and receiving a second RF signal comprising second position data recorded at a second time, and wherein predicting comprises predicting the position of the vehicle at the future time based on the first and second position data and the first and second times.

3. The method claimed in claim 1, wherein the position data includes coordinate data and motion data, and wherein predicting comprises predicting the position of the vehicle at the future time based on the coordinate data and motion data.

4. The method claimed in claim 1, wherein the position data comprises filter state variables related to position prediction.

5. The method claimed in claim 1, further including synchronizing time at the transponder and the roadside processor.

6. The method claimed in claim 1, wherein the ETC system includes a vehicle detector defining a vehicle detection area within the roadway, and wherein predicting the position includes predicting a time at which the vehicle is likely to reach the vehicle detection line.

7. The method claimed in claim 6, wherein predicting the position further includes predicting a lane in which the vehicle is likely to be located when the vehicle is predicted to reach the vehicle detection area.

8. The method claimed in claim 7, wherein the ETC system includes a roadside controller for conducting ETC transactions and correlating vehicle detection and toll transactions, and wherein the method further includes detecting a vehicle at the vehicle detection area, comparing the times at which vehicles are predicted to reach the vehicle detection line, and triggering an ETC event based on the comparison.

9. The method claimed in claim 1, wherein the ETC system includes a vehicle detector defining a vehicle detection point within the roadway, and wherein predicting the position includes predicting the vehicle location and calculating the distance from the vehicle location to the detection point.

10. The method claimed in claim 9, wherein the vehicle detector is to define multiple vehicle detection points, with such points being generally arranged orthogonal to the roadway, and such points may be associated with individual lanes of the roadway.

11. The method claimed in claim 9, wherein the ETC system includes a roadside controller for conducting ETC transactions and correlating vehicle detection and toll transactions, and wherein the method further includes detecting a vehicle at the vehicle detection point, comparing the position of the detection point with predicted positions of vehicles at the time of detection, and triggering an ETC event based on the comparison.

12. The method claimed in claim 8, wherein the ETC event is triggering of an enforcement system if the position of the vehicle detection does not correlate to the predicted positions of the vehicles.

13. The method claimed in claim 8, wherein the ETC event is triggering of an access system allowing the vehicle to proceed when a predicted vehicle position is correlated to the detection.

14. The method claimed in claim 8, wherein the ETC system tracks multiple vehicles within the coverage area and wherein comparing includes comparing the location of the detection points or area with the predictions for the multiple vehicles.

15. The method claimed in claim 2, wherein the transponder includes a position determination component and the method includes determining the first position at the first time and determining the second position at the second time.

16. The method claimed in claim 3, wherein the transponder includes a position and motion determination component and the method includes determining the coordinate data and motion data at the recorded time.

17. The method claimed in claim 1, wherein the ETC system further includes a legacy ETC system having a plurality of legacy antennas defining a narrow capture zone within the roadway and having a legacy reader, wherein the legacy ETC system employs a legacy communications protocol, and wherein predicting the position includes predicting a time at which the vehicle is likely to reach the narrow capture zone.

18. The method claimed in claim 17, wherein the ETC system further includes a roadside controller for conducting ETC toll transactions, and wherein the method includes reporting the presence of the transponder to the roadside controller at the time at which the vehicle is likely to reach the narrow capture zone.

19. An electronic toll collection (ETC) system for conducting toll transactions with a vehicle travelling in a multilane roadway through a toll area, the vehicle having a transponder configured to communicate using a wide area communications protocol, the system comprising:

a radio frequency (RF) communications unit and antenna having a coverage area encompassing a section of the multilane roadway in the toll area through which the vehicles travel;

a wide area reader to communicate with the transponder via the RF communications unit and antenna, the wide area reader including a vehicle position predictor to receive at least one RF signal from the transponder, the at least one RF signal comprising position data and a recorded time, wherein the recorded time is a time at which the position data was recorded by the transponder, wherein the position data comprises data regarding the vehicle's position in the toll area, and wherein the vehicle position predictor is to predict the position of the vehicle at a future time based on the position data and the recorded time; and a roadside controller to conduct ETC transactions, wherein the roadside controller is to receive data from the vehicle position predictor and to conduct an ETC transaction in relation to the vehicle.

20. The system claimed in claim 19, wherein the at least one RF signal comprises a first RF signal comprising first position data recorded at a first time and a second RF signal comprising second position data recorded at a second time, and wherein the vehicle position predictor is to predict the position of the vehicle at the future time based on the first and second position data and the first and second times.

21. The system claimed in claim 19, wherein the position data includes coordinate data and motion data, and wherein the vehicle position predictor is to predict the position of the vehicle at the future time based on the coordinate data and motion data.

22. The system claimed in claim 19, wherein the position data comprises filter state variables related to position prediction.

23. The system claimed in claim 19, wherein the transponder is to synchronize time with the wide area reader prior to transmitting the at least one RF signal.

24. The system claimed in claim 19, further including a vehicle detector defining a vehicle detection area within the roadway, and the vehicle position predictor is to predict a time at which the vehicle is likely to reach the vehicle detection area.

25. The system claimed in claim 24, wherein the vehicle position predictor is to predict a lane in which the vehicle is likely to be located when the vehicle is predicted to reach the vehicle detection line.

26. The system claimed in claim 25, further including an enforcement system, and wherein the roadside controller is to correlate vehicle detection and toll transactions by comparing a position of the detected vehicle with the lane and the time at which the vehicle is predicted to reach the vehicle detection line, and wherein the roadside controller is to trigger the enforcement system if the position of the detected vehicle does not correlate to the predicted position of the vehicle.

27. The system claimed in claim 26, wherein the ETC system is to track multiple vehicles within the coverage area and the roadside controller is to compare the position of the detected vehicle with predicted positions of the multiple vehicles.

28. The system claimed in claim 19 wherein the transponder includes a position determination component for determining the position data at the recorded time.

29. The system claimed in claim 19, wherein the ETC system further includes a legacy ETC system having a plurality of legacy antennas defining a narrow capture zone within the roadway and having a legacy reader, wherein the legacy ETC system employs a legacy communications protocol, and wherein the legacy reader includes a wide area handler for communicating with the wide area reader, and wherein the vehicle position predictor is to predict a time at which the vehicle is likely to reach the narrow capture zone.

30. The system claimed in claim 29, wherein the wide area handler is to report the presence of the transponder to the roadside controller at the time at which the vehicle is likely to reach the narrow capture zone.

* * * * *

UNITED STATES PATENT AND TRADEMARK OFFICE

CERTIFICATE OF CORRECTION

PATENT NO. : 8,384,560 B2
APPLICATION NO. : 12/398808
DATED : February 26, 2013
INVENTOR(S) : Alastair Malarky It is certified that error appears in the above-identified patent and that said Letters Patent is hereby corrected as shown below:

In the Claims:

Col. 14, line 67: replace “coverage area and” with --coverage area, and--

Signed and Sealed this
Sixteenth Day of July, 2013

Teresa Stanek Rea
*Acting Director of the United States Patent and Trademark Office*